United States Patent [19]

Schippers

[11] 4,035,879

[45] July 19, 1977

[54] APPARATUS FOR PRODUCING TEXTURIZED YARNS

[75] Inventor: Heinz Schippers, Remscheid, Germany

[73] Assignee: Barmag Barmer Maschinenfabrik Aktiengesellschaft, Wuppertal, Germany

[21] Appl. No.: 617,985

[22] Filed: Sept. 29, 1975

[30] Foreign Application Priority Data

Sept. 27, 1974 Germany ..... 2446139

[51] Int. Cl.[2] ..... D02G 1/00

[52] U.S. Cl. ..... 28/246; 264/168; 425/66

[58] Field of Search ..... 28/72.1, 1.2; 264/168; 425/66

[56] References Cited

U.S. PATENT DOCUMENTS

| | | | |
|---|---|---|---|
| 3,317,978 | 5/1967 | McIntosh et al. | 28/1.2 |
| 3,480,709 | 11/1969 | Jacob et al. | 28/72.1 X |
| 3,602,951 | 9/1971 | Stanley | 28/1.2 |
| 3,949,041 | 4/1976 | Schwarz | 28/1.2 X |

FOREIGN PATENT DOCUMENTS

| | | | |
|---|---|---|---|
| 809,273 | 2/1959 | United Kingdom | 28/259 |
| 939,314 | 10/1963 | United Kingdom | 264/168 |

*Primary Examiner*—Robert R. Mackey

*Attorney, Agent, or Firm*—Keil, Thompson & Shurtleff

[57] ABSTRACT

An apparatus for texturizing an initial rapidly melt-spun and preoriented thermoplastic yarn, especially a linear polyester yarn, wherein the initial yarn is subjected to draw-texturizing in a residual stretching stage with heating of the running yarn followed by unilateral or one-sided cooling to provide a temperature gradient over the transverse cross-section of the yarn and in a subsequent relaxation and heat-fixing stage to self-crimp the yarn under differential shrinkage. High yarn speeds are achieved in this draw-texturizing apparatus which is therefore especially useful in combination with rapid melt-spinning units.

11 Claims, 10 Drawing Figures

APPARATUS FOR PRODUCING TEXTURIZED YARNS

This invention is concerned with a process for the production of texturized yarns from synthetic thermoplastic fiber-forming polymers, preferably from linear polyesters with a crystallinity of less than 20%, by means of a physical aftertreatment of a melt-spun multifilament yarn which exhibits a relatively high degree of molecular orientation by using drawoff speeds of the filaments of 3,000 meters/minute or more in the spinning stage. The invention is also concernted with suitable apparatus for carrying out the texturizing process.

In past years, numerous processes have been proposed for the production and aftertreatment of synthetic fibers, especially continuous filament yarns. One such techology is that which is referred to as "stretch-spinning" or "rapid spinning." In this case, in contrast to the usual spinning and stretching process, no special means for stretching are used but instead the freshly melt-spun synthetic filaments ae drawn off at a substantially higher velocity from the spinning nozzle than that ordinarily used in melt-spinning processes and the resulting filaments are collected or spooled directly without the use of stretching godets or similar drawing means. Drawoff speeds of over 3,000 m/min. and preferably about 3,500 and 4,000 m/min. are used to achieve the desired initial orientation of the filaments.

Rapidly spun filaments or yarns of this kind are also designated as "spin-oriented" filaments or fibers. The molecular orientation of the fibers increases with an increase in the spinning velocity while the residual stretching still remaining or available in the rapidly spun filaments becomes gradually less. With drawoff spinning speeds on the order of about 6,000 m/min., the residual stretching reaches a value of 1:1.0. Therefore, drawoff speeds of between 3,000 and 6,000 m/min. constitute a technically useful range but still require an afterstretch or residual drawing step in an aftertreatment stage in order to achieve optimum textile properties.

It has also been suggested that a rapid spun yarn, e.g. one composed of linear polyester filaments, be subjected to an aftertreatment in a stretch-texturizing device in order to provide an integrated, continuous process for fully stretching the yarn on the one hand while simultaneously increasing its voluminosity or bulkiness by means of a mechanical texturizing treatment, for example in a false twist treatment. Such a stretch-texturizng process, whether a simultaneous procedure or a sequential process (two-zone stretch-texturizing process), was first carried out under various conditions after which it became apparent that the increased molecular preorientation of the rapidly spun filaments had an advantageous influence on the process parameters in the aftertreatment stage. In essence, it was found that the processability of the filaments on the stretch-texturizing machine became possible because preoriented filaments, in contrast to unstretched filaments, do not crystallize when brought into contact with a heating device at about 200° C and consequently do not become brittle and break. Filaments and yarns with physical textile properties could thereby be produced which differed slightly or not at all from conventionally stretched and texturized yarns. The newly developed rapid spinning and stretch-texturizing could thus compete with previous methods while offering potential savings in production costs as well as certain variations in aftertreatment possibilities and a corresponding wider range of use for the final products.

It is possible, of course, through the technology of the rapid spinning process, to produce synthetic filaments of yarns from fiber-forming polymers for texturization in a considerable more productive fashion at least during the spinning stage due to increased output or supply capacity of each spinning nozzle or spinning unit. On the other hand, an upper limit is placed upon the thread or yarn speed in the stretch-texturizing apparatus as deemed by the technically feasible and reasonably controllable rotational speed of the false-twist assembly. This rotational speed for false-twisting is presently limited in magnetic false-twist spindles to about 800,000 r.p.m. which corresponds to a maximum thread speed of approximately 250 meters per minute when using, for example, a fine thread or yarn of 32 filaments having a yarn size of 167 dtex and a twist of about 2,500 turns per meter of the running thread.

Even when using a frictional false-twist assembly, the thread speed is still limited during texturizing to an upper limit of not more than about 600 meters per minute, since otherwise a very irregular and non-uniform yarn of inferior quality is produced with no practical utility. In this case, the calculation of the thread speed is based upon a rotational speed of the frictional false-twist assembly of about 1,500,000 r.p.m. It must be observed, however, that the actual or effective rotational speed of the fractional false-twister must be considerably higher to compensate for slippage on the circumference of the twist-imparting elements. Thus, the actual speeds must reach values of about 2,500,000 r.p.m. which represent an upper limiting capacity.

As a practical matter, it is thus apparent that presently available texturing devices such as the false-twist spindles, frictional false-twist wheels and the like cannot be operated at linear thread or yarn speeds of much more than about 600 m/min. and certainly not in excess of 1,000 m/min. As a result, one cannot achieve a true combination or continuous process with rapid spinning and draw- or stretch-texturizing being carried out sequentially on a single length of thread or yarn, i.e. so as to achieve speeds on the order of 3,000 to 6,000 m/min. The use of jet texturizing or other available means of crimping and bulking yarns has also presented serious problems in terms of available thread speeds, yarn quality and the like. In general, then, available texturizing techniques cannot be controlled at high speeds to yield a satisfactory yarn with uniform physical properties and a reproducible texturized effect.

Accordingly, it is an object of the present invention to provide a process and apparatus in which high-speed draw-texturizing can be carried out with linear yarn speeds sufficiently high to be combined with rapid spinning speeds, i.e. so as to substantially exceed prior false-twist texturizing yarn speeds having upper limits of 600 and not more than 1,000 meters per minute. It is also an object of the invention to provide a process for continuously producing the texturized yarns in a sequential or combined rapid spinning and draw-texturizing operation so as to ensure highly uniform and easily reproducible texturized or bulked yarns having a heat-set durable crimp and exhibiting excellent physical properties as a filamentary textile material.

Such objects are achieved in accordance with the present invention by means of a multi-stage draw-texturizing process for producing texturized multifilament yarns from synthetic thermoplastic fiber-forming polymers, said process including the steps of residually stretching in one stage of a preoriented multifilament yarn consisting essentially of said fiber-forming polymer as attained by melt-spinning the polymer at a draw-off speed of more than about 3,000 meters per minute, said residual stretching being carried out between a feed point and a draw point over a first heat treatment zone in which the filaments of the yarn are spread out as a small flat bond which is then first conducted over a contact heater and is then directly quenched from the opposite side to create a temperature gradient over the transverse cross-section of the individual filaments, and crimping the yarn from the preceding residual stretching stage by differential shrinkage in a second heat treatment zone in which the running yarn is heat fixed under adjustable relaxation conditions.

This process of the invention is described more fully hereinafter together with suitable apparatus used or combined in a preferred manner for purposes of the invention, reference being made to the accompanying drawings in which:

FIG. 1*a* is a schematic illustration of typical apparatus used in the rapid spinning of synthetic filaments while drawing off such filaments over two godets;

FIG. 1*b* is a schematic illustration of the same rapid spinning apparatus shown in FIG. 1*a* but using only the winding means to draw off the melt-spun filamentary yarn;

FIGS. 2*a*, 2*b*, 2*c* and 2*d* each represent useful cross-sectional shapes of individual filaments of special value for the process of the invention;

Figure 1A:
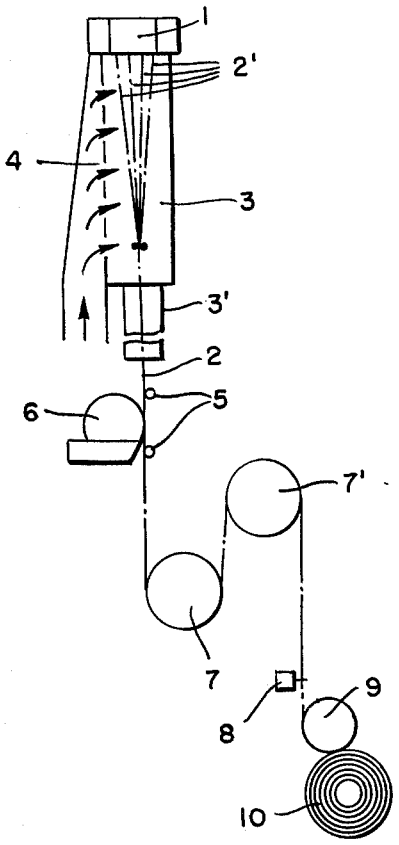
FIG. 1a PRIOR ART
Figure 1B:
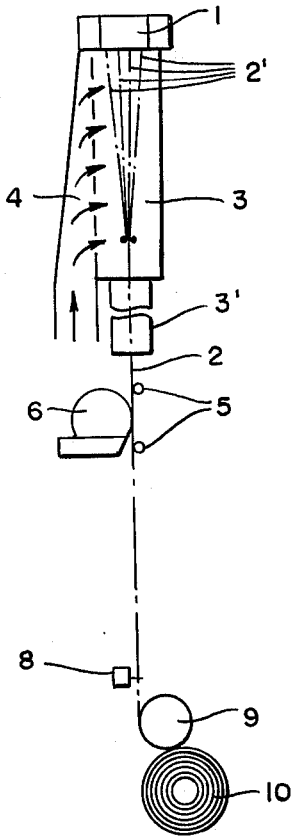
FIG. 1b PRIOR ART
Figure 2A:
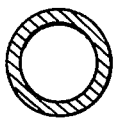
PRIOR ART FIG. 2a
Figure 2B:
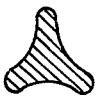
PRIOR ART FIG. 2b
Figure 2C:
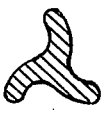
PRIOR ART FIG. 2c
Figure 2D:
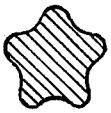
PRIOR ART FIG. 2d

The initial rapid spinning procedure is known and can be readily understood by reference to FIGS. 1*a* and1*b* wherein the spinning head 1 of a conventional melt-spinning extruder is employed to produce a multifilament yarn 2 with a high output of the molten fiber-forming polymer, e.g. polyethylene terephthalate, individual filaments 2' being formed by a nozzle plate having a plurality of spinning orifices, preferably to yield the preferred cross-sectional features of these individual filaments as illustrated in FIGS. 2*a*, *b*, *c* and *d*. In this respect, the process of the invntion is enhanced by using hollow filaments such as those of FIG. 2*a*, or by using various shaped trilobal filaments such as those of FIGS. 2*b* or *c*, as well as multilobal filaments having four, five or more lobes as indicated by FIG. 2*d*. Special extrusion or nozzle plates are readily available to provide these preferred filamentary cross-sections, all of which favor the development of a temperature gradient over a transverse cross-section of the yarn (laterally or perpendicularly to the linear yarn path or running direction of the yarn).

The initially melt-spun filaments 2', which are collected into the multifilament yarn 2, are essentially amorphous or non-crystalline and exhibit practically no molecular orientation as they emerge from the spinning head 1, and under ordinary spinning conditions at draw-off or winding speeds which are relatively low, i.e. well below 1,000 meters per minute, the freshly spun and solidified filaments do not achieve any useful orientation without being subjected to special drawing or stretching procedures, e.g. as in well-known processes commonly referred to as "spin-drawing" where a slow spinning step is combined with a somewhat faster stretching step depending upon the stretch or draw ratio. However, where these initially melt-spun filaments are rapidly spun at high draw-off or winding speeds of about 3,000–6,000 m/min, it is possible to provide a preoriented yarn capable of being wound and/or processed in subsequent yarn treatment operations. See, for example, U.S. Pat. No. 3,771,307 which issued Nov. 13, 1973, the subject matter of which is incorporated herein by reference with respect to its rapid spinning features using polyester filaments.

Preoriented yarns obtained by the rapid spinning process are essential for purposes of the present invention, i.e. as obtained at winding or draw-off speeds of 3,000–6,000 m/min., such yarns having a relatively high molecular orientation but exhibiting a crystallinity of less than 30% and preferably not more than about 20%.

The properties of "molecular orientation" and "crystallinity" are well-defined in the synthetic fiber art as indicated by the standard reference of Moncrieff, "Artificial Fibres," 2nd Edition, pages 29–72, John Wiley & Sons, Inc. (1954). The measurement of crystallinity is also defined in the above-mentioned U.S. Pat. No. 3,771,307.

Attention is further directed to U.S. Pat. No. 3,837,156, issued to Langanke et al on Sept. 24, 1974, which also discloses rapid spinning step which is useful for purposes of the present invention, i.e. to provide a prestretched or preoriented initial a rapid melt-spun yarn, preferably at draw-off or winding speeds above 3,000 meters per minute, e.g. in a preferred range of 3,000–4,000 meters per minute. Thus, it is quite useful to provide a rapidly spun prestretched but still drawable untextured yarn under such known conditions for subsequent draw-texturizing in accordance with the present invention.

As the individual filaments 2' are drawn off at high speed from the spinning head 1 and collected into the yarn 2, they are cooled for solidification by air or an inert gas blown thereon in a conventional manner as indicated by the arrows in the air inlet 4 of the spinning shaft 3. After leaving the bottom end of the drop shaft 3' (which is a lower extension of the spinning shaft 3), the yarn 2 is preferably supplied with a suitable yarn presentation in the form of a liquid coating agent by conducting it between thread guide elements 5 over the coating device 6. Compare, for example, the generally known procedure disclosed in Gage, U.S. Pat. No. 3,433,008, issued Mar. 18, 1969. The preparations applied at this point may be for special lubricating purposes aside from the subsequent application of a finishing agent or wetting liquid as described more fully hereinafter as a preferred feature of the present invention.

According to FIG. 1*a*, the filamentary bundle consisting essentially of a substantially non-twisted yarn 2 is drawn off by the pair of godets 7, 7' at high speeds from the spinning nozzle of the spinning head 1. The yarn is not fully wrapped around these godets 7, 7' and care is taken not to stretch or draw the yarn at this point but only to transport the filaments away from the spinning head. Thus, there is no stretching between 7 and 7'. Instead, these draw-off godets are operated at substantially the same speed in order to impart a so-called "predraw" to the freshly spun filaments as they emerge from the spinning head and to obtain the desired preorientation of the individual filaments. From the godet 7', the predrawn filamentary yarn 2 is applied by a conventional traversing mechanism 8 and drive roll 9 onto a cross-wound bobbin 10 or a similar winding spool or bobbin. A friction drive roll 9 can be used to advantage to achieve a carefully wound bobbin free of undesirable stresses or tensions on the preoriented yarn. A damage-free winding of the yarn can be achieved, for example, by using the spooling means according to U.S. Pat. No. 3,913,852.

FIG. 1*b* differs from FIG. 1*a* in that the godets 7, 7' are omitted and the pulling force required to draw off and simultaneously preorient or predraw the freshly melt-spun filaments of the yarn 2 is provided solely by the spooling means, e.g. by the frictional roller 9. The spooling device is driven at a circumferential velocity of more than about 3,000 meters per minute and preferably less that 6,000 meters per minute.

The individual filaments preferably have the cross-sections as defined above in connection with FIGS. 2*a* –2*d*, it being understood that there is a substantial body of prior art directed to the initial spinning or extrusion of these filaments so that elaboration of their production is not required here.

Figure 3:
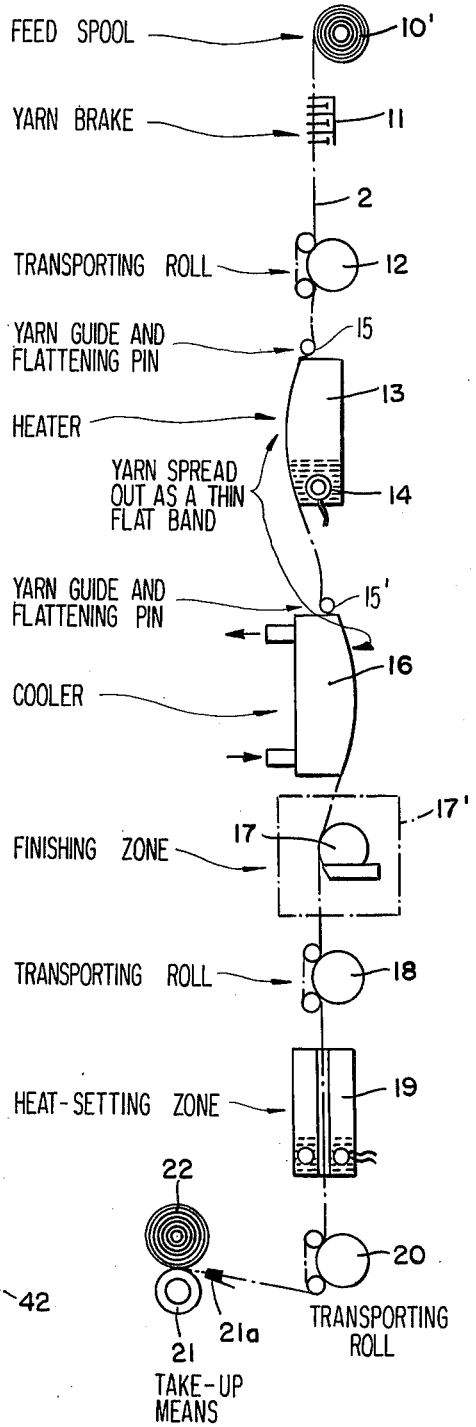
FIG. 3 is a schematic illustration of the essential draw-texturizing apparatus used in the process of the invention in an especially preferred combination.

FIG. 3 provides a complete schematic illustration of the course or path of the yarn in the draw-texturizing process and apparatus according to the present invention. In this embodiment, the first spool 10' corresponds to the winding package or bobbin 10 of FIGS. 1*a* and 1*b*. It is also possible, however, to conduct the predrawn filaments directly from the draw-off rolls or godets 7, 7' into the draw-texturizing process of the present invention, thereby eliminating the bobbin 10' and going directly from godet 7' into the draw-texturizing stage of the new process. In commercial practice, the preoriented rapidly spun yarn is most often supplied by the yarn producer who has facilities for carefully producing the initial yarn according to various yarn sizes, tensile and elongation properties and the like as adapted to a large number of customers who then prefer to provide their own draw-texturizing and finishing treatments for particular end uses of the yarn. However, the present invention has the advantage of permitting the producer to also provide texturized yarns in a single continuous process while maintaining high standards in the uniformity and quality of the final product. Accordingly, the present invention is not limited to the embodiments of FIGS. 1*a*, 1*b* and FIG. 3, but also includes a combination of these distinct stages into an overall continuous rapid production of texturized yarns having optimum textile properties.

As the yarn 2 is fed into the draw-texturizing stage, it is preferable to brake the feed spool 10' and/or to provide a fence- or gate-type braking device 11 of intermeshing rods as the braking elements in order to carefully control the tension and to adjust it in known manner to provide a smooth and trouble-free supply of yarn. Drawing of the yarn 2 is accomplished by means of a first yarn transporting means such as the roller assembly 12 acting as feed means and a second yarn transporting means such as the roller assembly 18 acting as draw means. These roller assemblies may be constructed as belt- or band-operated transporting or forwarding means for the yarn, which are well known with conventional means to adjust their speed with respect to each other, i.e. the circumferential speed of the transporting roller or the linear speed of the conveying band, in order to produce the desired amount of stretch or draw.

For higher yarn speeds, i.e. in the combined spin-draw texturizing process, suitable pairs of driven rolls or godets with proper air-supported yarn overrun rollers, well known in the art, are preferred yarn transporting and forwarding means.

For purposes of the present invention, it is generally desirable to provide a draw ratio of about 1:1,1 to 1:2,4, and especially between about 1:1,4 to 1:2,0 in the residual stretching stage.

Between the first and second yarn transporting means 12 and 18, it is essential for purposes of the present invention to provide two thermal treatment means in direct sequence, one after the other, consisting of a heating means 13 immediately followed by a quenching means 16. The first heating means 13 is preferably a yarn contact heter arranged in a conventional vertical manner with an elongated slightly curved contact heating plate over which the yarn 2 runs or is transported during the first portion of the residual drawing or stretching stage of the invention. This contact heater 13 is supplied with a fluid heating medium such as steam by means of a conventional heating element 14 located in the liquid pool or reservoir at the bottom of the heater or preferably from a common reservoir or manifold as is common in such heaters arranged to handle several spinning units at the same time. Other fluid heat exchange substances may be used besides water/steam, and the temperature of the heater 13 is easily controlled to avoid damage or loss of textile properties due to overheating the yarn.

Figure 4:
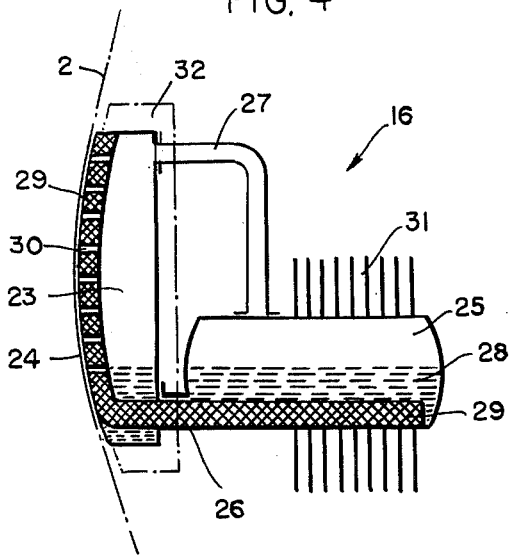
FIG. 4 is a longitudinal section through an unilateral cooling means constructed according to one preferred embodiment of the invention.
Figure 5:
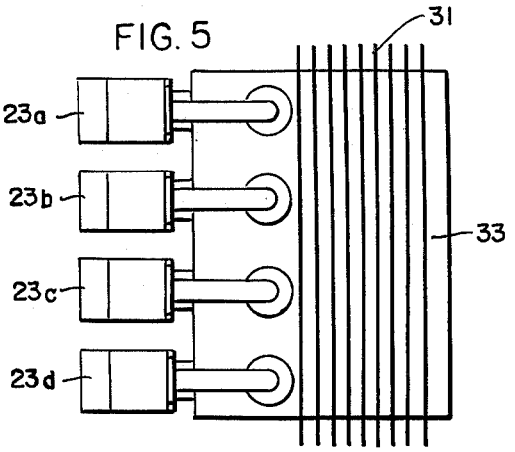
FIG. 5 is a top plan view of several evaporator sections of the cooling means of the invention combined with a common condenser section.
Figure 6:
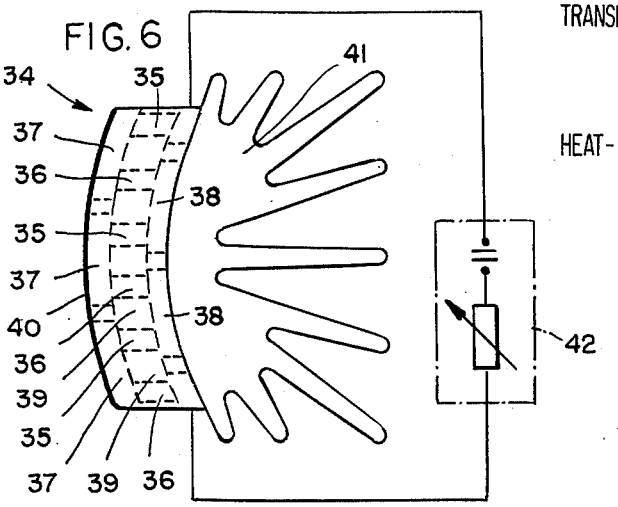
FIG. 6 is a schematic representation of the use of Peltier elements for the coolable yarn contacting surfaces of the unilateral cooling means of FIGS. 4 and 5.

It is not absolutely essential to employ a yarn contact heater 13 as shown in FIG. 3, likewise electrically or vapour heated pins, which are circumferentially wrapped by the yarn at angles from 15° to 180°, preferably from 90° to 180° can be applied as a yarn heating means; in addition these pins effect a good spreading of the yarn in the heated surface; but it has been found to be especially helpful in producing the desired temperature gradient over the transverse cross-section of the yarn when combined with the immediately subsequent unilateral cooling means 16 which is described in greater detail in connection with FIGS. 4, 5 and 6 below. Thus, the cooling means 16 must provide a quenching surface in direct contact with the filaments of the yarn running thereover as indicated by the yarn path in FIG. 3 over the elongated vertical contact surface of the cooling device 16. It will be noted that this contact surface of cooler 16 curves in the opposite direction from the contact surface of the heater 13, thereby first heating the filaments of the yarn from one side and then quenching it from the opposite side. In this manner, it is possible to ensure the greatest possible temperature gradient over the individual filaments of the rapidly running yarn while avoiding excessive heating at the heater 13.

The temperatures of the heating and cooling means 13 and 16, respectively, can be varied within wide limits depending upon all of the other conditions of the process, the particular yarn being treated, etc. In working with most thermoplastic filaments, especially polyethylene terephthalate filaments, the temperature of the heated surface of the contact heater 13 is generally maintained between about 180° and 280° C, preferably about 200° to 270° C. The heated contact surface of the heater 13 is preferably maintained as close as possible to the softening temperature of the filamentary material. The most useful temperatures with any given yarn as a function of the polymer and the cross-sectional structure of the filament, i.e. the hollow or multilobal cross-sectional structure, can be readily determined by a few preliminary tests at various linear yarn speeds.

The quenching step on the unilateral cooling means is not critical, but is preferably maintained at the lowest possible level commensurate with reasonable costs and available cooling agents. In general, it has been found to be most helpful to work at cooling temperatures applied from the side of the running filaments, not having contacted the heater of about −5° to 40° C preferably 10° to 20° C.

Following the cooling means 16, it is especially preferred to arrange a conventional roller or spray device to apply a finishing agent onto the running yarn. A typical spray nozzle directed from one or both sides of the running yarn has the advantage of atomizing the finishing agent as a liquid into a very fine vapor of finely divided droplets so as to gently coat the running yarn. Such spraying can also be achieved by running the yarn through the spray chamber 17' (indicated in broken lines).

The yarn supplied as a bundle of preoriented filaments from feed spool 10' is thus drawn between the feed and draw means 12 and 18 in order to complete the stretching still required to achieve final textile properties, referred to achieve final textile properties, referred to herein as the "residual stretching," while the same yarn is simultaneously subjected to an asymmetrical or unilateral thermal treatment causing a definite temperature gradient to be imposed transversely of the linear running direction of each individual filament of the yarn. This combined residual drawing and uniposed temperature gradient permits one to achieve a yarn of substantially increased voluminosity or bulkiness upon release of tension, preferably under a controlled relaxation of tension following the draw means 18. The yarn is thus suprisingly found to provide excellent self-crimping properties at high yarn speeds.

Thus, the filaments of the running yarn heated up to the vicinity of their softening point along one side on heater 13 are immediately quenched from the opposite side on the cooling means 16, a finishing agent applied at 17, and the yarn then fed by draw means 18 to a final relaxation under controlled conditions as established by the third yarn transporting means 20 with the indirect heating means 19 permitting the crimp or texturizing effect to be heat-set and durably imposed on the yarn. This heating means 19 is preferably an enclosed tube or chamber with heat supplied by radiation or convection and without directly contracting the yarn. Such heaters are quite conventional in this art.

The amount of self-crimping and increase in voluminosity of the yarn is directly dependent upon the differential shrinkage of the individual filaments over the yarn cross-section as established by the imposed temperature gradient. it is also desirable to carefully control the relaxation tension to develop a uniform texturizing effect.

The texturized and heat set yarn is finally withdrawn and wound on the take-up roll or spool 22 operated by drive roll 21. The yarn can be carefully wound under a controlled thread tension by means of a conventional motor-driven spooling device including the roll 21 with traversing means **21*a* which together preferably form a cross-wound cylindrical bobbin 22. It is also possible to use other yarn collecting means including storage cans or boxes, e.g. where tension on the yarn is to be completely released after the final yarn transporting assembly 20 or even 18** if there is no immediate heat-setting or heat-fixing of the self-crimped yarn. These and similar variations in the final relaxation and collection of the yarn can be readily adapted from existing processes and apparatus.

In general, the temperatures and other parameters of the rapid spinning and draw-texturizing stages of the process as discussed herein are made with reference to the production of a polyester (polyethylene terephthalate) yarn as a convenient way to illustrate one especially preferred type of yarn produced according to the invention. Thus, such conditions as temperature, yarn speed, drawing ratio, relaxation of tension and the like must always be varied to provide th most optimum conditions for the particular yarn being produced. Therefore, while such processing conditions are subject to wide variance within the scope of the present invention, it will be understood that the self-crimping imparted by the differential cooling or chilling effect, i.e. by establishing a temperature gradient over the individual filament cross-section, is best achieved by creating the greatest possible temperature drop from one side of the filaments to the other.

This desired temperature gradient is also more easily established by using suitable finishing agents dissolved or emulsified in a solvent carrier which is easily vaporized at high thread temperatures. This not only protects those filaments exposed to the highest yarn heating temperatures but also tends to provide a more uniform and controlled temperature gradient over the yarn cross-section. The finishing agent may of course also serve other normal purposes of improving the integrity or cohesiveness of the filamentary bundle in the yarn and to reduce friction against contact surfaces, yarn guides and the like. However, the main purpose of the finishing agents in the present invention, as applied prior to or during the draw-texturizing stage, is to ensure a favorable heat transfer from filament to filament over the yarn cross-section.

Various asymmetrical heat treatments have been suggested in conventional spinning stages and also in conventional texturizing stages, but under the usual conditions of spinning and texturizing at relatively lower speeds below 3,000 meters per minute and with the usual filamentary yarns, such asymmetrical heat treatments are of practically no commercial value on yarns or filamentary bundles composed of a homogeneous thermoplastic fiber-forming polymer material such as polyethylene terephthalate, nylon or the like. The flexibility of these processes is insufficient and it has not been possible to influence textile properties to any significant extent and usually not at all by merely applying a heating or cooling from one side of the homogeneous filamentary bundle, i.e. the yarn being treated.

The term "homogeneous" is used here to define a yarn in which all the filaments are composed of the same polymer and melt-spun under substantially the same conditions so that each filament has approximately the same initial properties over its cross-section, differing only in diameter or lobal configuration as between different filaments or yarns. Such filaments and yarns are very easy to produce under rapid spinning conditions from any of the well-known fiber-forming polymers but especially linear polyesters and linear polyamides (nylons).

Surprisingly, it has now been found that by using a sufficiently low temperature over an elongated cooling surface in direct contact with a rapid-spun and preoriented fiber-forming polymer yarn, which is simultaneously being residually stretched or drawn to its final orientation, one can achieve an excellent texturizing effect through a combination of the imposed transverse temperature gradient and the draw-texturizing of the initially heated yarn, preferably with a contact heater from the opposite side of the yarn. The preorientation in the spinning stage and the accompanying residual stretching in the draw-texturizing stage greatly enhances the flexibility of the process. At the same time than those speeds available in the use of false twist texturizing machines.

The overall process of the present invention thus not only achieves high yarn speeds and a surprisingly increased bulkiness or voluminosity in a self-crimping or self-texturizing effect, but this process is also one which maintains good textile properties in the final yarn product and which can be easily controlled to yield homogeneous threads or yarns of very uniform properties, handle and processability.

The present invention is also directed in part to the essential apparatus and subcombinations thereof which are especially useful in carrying out the process. Aside from the conventional rapid spinning apparatus used in the first stage, it is necessary in the second or draw-texturizing stage to use a reel-type runoff frame with at least three yarn transporting systems or roller assemblies 12, 18 and 20 as indicated in FIG. 3. Conventional means such as variable speed motors are used to operate these yarn transporting systems at speeds which are adjustable with respect to each other to control the draw ratio and subsequent relaxation under controlled tension which are applied to the running yarn. The yarn transports or roller assemblies are spaced apart sufficiently far to accommodate at least one heating device between each pair of transport means as required for drawing or stretching between the first and second transport means and for heat-setting between the second and third transport means. It is feasible, of course to add further transport means and additional means for heating the yarn, but it is desirable to use the smallest number of machine or apparatus elements as are required to carry out the process. All of the just described apparatus is generally available and commonly employed in textile machines, including a final winding or take-up means, preferably operated under a controlled tension winding to maintain a uniform product.

In an especially preferred embodiment of the invention as shown in greater detail in FIGS. 4, 5 and 6, the essential yarn cooling or chilling device for producing the temperature gradient over the yarn cross-section is preferably constructed as a pressure-tight, sealed or closed hollow body having a metallic surface in direct contact with the running yarn along one side thereof and containing a fluid cooling medium which is vaporizable in heat exchange with the metallic yarn contacting surface. This cooling medium as a liquid is automatically brought by wick means, i.e. a capillary effect, along the inner surface of the hollow body for indirect heat exchange with the yarn contacting surface. The boiling point of the cooling liquid and the pressure within the hollow body are adjusted so that the cooling liquid vaporizes above room temperature and uses its heat of vaporization to withdraw heat from the metallic surface in contact with the running hot yarn. At a point in the hollow body which is more remote from the metallic surface being cooled, the cooling medium is cooled and condensed by giving up its heat of vaporization to the surrounding atmosphere, e.g. by providing a condenser section with cooling fins on its outer surface.

The preferred unilateral cooling apparatus of the invention thus includes a hollow body with an evaporator section having an enlarged inner surface area of heat conducting elements in heat exchange with the metallic surface which is placed in contact with the running yarn. The hollow body also has a condenser section in fluid communication with the evaporator section to receive the vaporized cooling medium and a capillary or wick means extending from the condenser section into the evaporator section to conduct liquid cooling medium along the heat-conducting elements which withdraw heat from the outer metallic yarn-contacting surface.

The evaporator section is preferably arranged vertically with a condenser section protruding horizontally and in liquid connection at the lower end of the evaporator section and in gaseous connection at the upper end of the evaporator section, thereby permitting a circulation of the cooling medium, first as a liquid into the evaporator section and then as a gas into the condenser section. The capillary means preferably extends from a lower reservoir or bottom zone of the combined condenser and evaporator sections so as to reach the upper inner surface area of the evaporator section. In essence, the evaporation of the liquid cooling medium can take place over the entire vertical portion of the evaporator section which forms the inner wall and heat-conducting elements in heat exchange with the outer yarn contacting surface of the unilateral cooling device.

The yarn cooling or chilling device is easily constructed as a hollow body with an enlarged specific surface area arranged internally in the evaporator section and externally in the condenser section to maximize the rate of heat transfer. Any suitable cooling liquid may be used, e.g. as is common in refrigeration systems, provided that its boiling point is sufficiently above room temperature to permit a condensation of the vaporous cooling medium in the condenser section of the apparatus.

The term "room temperature" is used in the sense of this application to define that temperature at which one normally operates in a room intended for texturizing devices, especially that temperature used for the climatization for conditioning of a yarn production room. Such temperatures generally will be maintained from about 15°–30° C. or preferably about 20°–25° C. Heat from the melt-spinning process is preferably withdrawn or kept in a separate room or chamber away from the texturizing apparatus.

The term "specific surface area" is used to define the geometric surfaces used for heat transfer taken with reference to the volume of the member being cooled and/or heated.

The "capillary means" or "wick" is used herein with reference to a wide variety of suitable absorbent structures, all of which have an open-pored structure with capillary canals which cause the cooling liquid to be self-transported by capillary action of the wick, i.e. surface tension forces between the wick and the cooling liquid. Such wicks may be formed of fibrous materials or suitable sintered powdery materials including sintered or compressed ceramic and metallic materials.

The preferred hollow body construction of the cooling device of the invention as indicated hereinafter is essentially based on the principles of the so-called "heat pipe" as described for example in Scientific American, May 1968, Vol. 218, No. 5, pp. 38–46, the subject matter of which is incorporated herein by reference as fully as if set forth in its entirety.

It is further especially advantageous to use a cooling device employing Peltier elements alone or in combination with the cooling device operating on the so-called "heat pipe" principle. In the present case, the hollow body construction of the unilateral cooling device of the invention is in the nature of a "cold pipe" heat being transferred away from the metallic yarn contacting surface by the evaporator section to the condenser section with an automatic recirculation of the cooling medium. The Peltier elements are of particular value as a means of adjusting and maintaining the cooling temperature of the yarn contacting surface and especially as a means of increasing the rate of heat transfer away from the yarn contacting surface. These Peltier elements operate in accordance with a well known thermoelectric effect, i.e. with a conduction of electrical current through the Peltier element, heat is transferred from one side of the element to the other.

Referring now to FIGS. 4 and 5 of the drawing, there is illustrated a special yarn runover or yarn contacting hollow body in accordance with the invention. The cooling device 16 corresponds to that illustrated schematically in FIG. 3 except that the yarn contacting surface faces in the opposite direction and the construction corresponds to the preferred "heating pipe" or more correctly, a "cold pipe" required for the present invention. As indicated in FIG. 4, the yarn contacting portion of the cooling device is provided by a metallic hollow body 23 representing the evaporator section and having a slightly curved, smooth outer surface 24 for direct contact with the running yarn 2. This evaporator section 23 is in pressure-tight fluid connection with the condenser section 25 extending horizontally rearwardly at the lower end of the evaporator section. The fluid connection 26 at the lower portion of the combined evaporator and condenser permits flow of liquid from the condenser 25 into the evaporator 23. At the same time, vaporized or gaseous cooling medium flows through the fluid connection 27 from the end of the evaporator 23 into the upper portion of the condenser 25. The cooling liquid 28 which collects in the bottom of the condenser 25 and permissibly in the lower part of the evaporator 23 is transported by capillary action through the wick 29 upwardly along the inward surface of the evaporator directly behind the yarn contacting surface 24.

The entire system is hermetically sealed after it is partially filled with a sufficient amount of the cooling medium and after evacuating the vapor zones in the evaporator and condenser so as to remove inert residual gases incapable of condensing at the desired room temperature of the condenser. In this closed system, the selected cooling medium 28 evaporates in the vapor zone 23 with a corresponding increase in pressure so that the vapors tend to flow through the fluid conduit 27 into the vapor zone of the condenser 25. At the time, the condensed liquid cooling medium 28 is cycled back to the evaporator 23 by the capillary action of the wick 29 extending through the bottom fluid connection 26 into the evaporator 23.

The wick 29, which may be glued or adhered onto the inner side of the evaporator 23, has a number of openings 30 to permit an unrestricted conduction of the vaporized cooling medium away from the curved metal wall 24, the resulting heat of vaporization through line 27. In this manner, an effective withdrawal of heat takes place continuously from the evaporator into the condenser. The wick 29 is preferably constructed of a fleece or felt-like fibrous material or a sintered porous metal with a good absorption for the cooling liquid as well as a strong capillary action.

In order to improve the condensation of the cooling medium at, or slightly above room temperature, it is desirable to substantially increase the outer surface of the condenser section 25, for example by means of a number of ribs or cooling fins 31. The high specific surface area provided by these cooling fins permits a rapid dissipation of heat from the condenser 25 to the surrounding atmosphere, and this heat dissipation can be further increased by forced air circulation over the cooling fins 31.

That portion of the evaporator which is to be protected against undesired heat radiation is preferably surrounded by a thermal insulation material 32 as indicated in FIG. 4. In this respect, the connecting conduits or lines 26 and 27 may also be partly or completely insulated against heat loss. The thermal insulation of the evaporator is especially essential in order to maintain the flow of the cooling medium in a definite direction.

In FIG. 5, a number of yarn runover or yarn contacting members 23 of the type shown in FIG. 4 are collected together into a series of such yarn contacting members 23*a*, 23*b*, 23*c*, and 23*d*, which are arranged alongside one another as separate evaporator sections mounted on a single common condenser section 33 with its cooling fins 31. The construction of FIG. 5 thus corresponds to that of FIG. 4 except for the use of a common condenser 25 in fluid connection with the individual evaporators acting as yarn contacting members. This construction is especially advantageous because the connection of several evaporator sections onto a single condenser guarantees a uniform temperature over all the evaporators and their yarn contacting surfaces due to the self-regulating effect of the "cold pipe" arrangement. The temperature thus remains uniform in spite of variation in the amount of cooling medium being vaporized at various points in the evaporators, i.e. along the inner surface of the yarn contacting members 23*a, b, c,* and *d.*

A number of these condensers 33 containing a plurality of evaporator sections as yarn contacting members 23, can be positioned longitudinally of the texturizing machine, preferably, in the vicinity of or directly in the path of a stream of air used to maintain the controlled climate of the machine room. This incoming air for climatization may thus also be used as a forced air circulation to increase the cooling capacity of the yarn contacting members. This same arrangement is also preferred when using any other cooling device such as a yarn contacting plate cooled by Peltier elements alone or in combination with the "cold pipe" construction.

FIG. 6 provides a schematic illustration of a yarn runover or yarn contacting member 34 which is cooled by Peltier elements so as to permit a careful adjustment and maintenance of the surface temperature required in cooling the filaments of the yarn from one side only.

The individual Peltier elements are shown connected electrically in series but thermally in parallel for increased refrigerating capacity, and in each case the Peltier element consists of two flanks or side members 35 and 36 of a dosed semiconductor material connected at either end by cold and warm copper contact bridges 37 and 38. For reasons of stability and permanent installation, the Peltier elements are preferably embedded in a synthetic resin molding or reinforcing material 39. Such Peltier elements can be easily manufactured in accordance with industrial standards and arranged within the evaporator section 23 along the heat-conducting and yarn-contacting surface such as the curved metal plate 40, the interstices or gaps between the Peltier elements being filled by the synthetic resin 39 as an inert and non-conducting material.

As further indicated by FIG. 6, there is a good heat transfer between the wear-resistant, metallic outer metal plate 40 and the connected cold contact bridges 37 at the outer end of the Peltier elements. At the same time. there is also a good heat transfer between the warm contact bridges 38 at the inner end of the Peltier elements and a heat exchange block 41 which has a high specific surface area for an efficient and high capacity transfer of heat to the circulating cooling medium.

It is of special advantage that the cooling device made up of Peltier elements as shown in FIG. 6 can be used directly by itself without being inserted into a refrigerating cycle of the hollow body shown in FIGS. 4 and 5. This is particularly possible where the unilateral cooling surface 40 connected to the Peltier elements 35, 36 and the heat exchange block 41 over cold and warm bridges 37 and 38 can be operated in conjunction with a rapid spinning and/or high speed draw-texturizing machine. The controlled supply of electrical current to the Peltier elements is indicated by the power source and regulatable voltage of box 42. The heating block 41 then has sufficient cooling fins to permit heat dissipation to the surrounding atmosphere, preferably with a forced circulation of air over these cooling fins.

The Peltier elements available today are based upon modern semiconductor materials having a good refrigerating capacity so as to be advantageously used as the essential cooling means in direct heat exchange, i.e. at one end over suitable metallic bridges, with the elongated metallic surface being contacted by the hot running yarn. In turn, the Peltier elements can be connected at their opposite end over such metallic bridges to a heat dissipating means of any desired capacity capable of handling the heat as it is removed from the running yarn.

The temperature drop created by the Peltier elements is sufficient to pump thermal energy from one side of the element to the other where this thermal energy can be dissipated as described in a most convenient manner.

Thus, the cooling devices proposed for the process of the present invention have the principle advantage that they can be operated without adding any mechanically movable parts to the existing textile machinery. Thus, no pumps, valves or the like are required to circulate a cooling medium so that the required apparatus, e.g. a closed pressure-tight vessel, is not subject to being shut down and requires practically no maintenance.

The advantage of using Peltier elements in accordance with the invention resides in the fact that there is an immediate conversion of electrical energy into a transfer of heat and its rapid dissipation. Refrigeration is thus produced on a yarn contacting-surface with high efficiency and practially no losses in transmission away from this yarn contacting surface.

Moreover, the expense in producing the required cooling effect with a relatively high refrigerating capacity and the operating costs are both very minimal, even with respect to the Peltier elements, because most texturizing machines are now provided with suitable direct current generators, transformers and rectifiers for the production of direct electrical current. The Peltier elements have a further advantage in that they are much less susceptible to disturbances or interruptions than conventional refrigerating apparatus.

The present invention is thus essentially directed to a high-speed, self-crimping of preoriented and draw-texturized synthetic continuous filament yarns requiring a unilateral or asymmetrical cooling or chilling effect as applied by especially adapted cooling devices, these devices being uniquely suited for use in combination with rapid-spinning apparatus and/or high-speed texturizing devices. Most importantly, the invention permits a high speed texturization of the yarn without being limited by the use of mechanically operated texturizing devices. The speed of the process of the invention is limited instead only by the efficiency of the cooling devices and the upper limits of permissible preorientation in the initial melt-spun yarn. Having provided satisfactory cooling devices with very high heat transfer capacities, the draw-texturizing process can now be effectively carried out on the preoriented yarn at the highest possible linear yarn speeds.

EXAMPLE

A multi-filament polyethylene terephthalate yarn, composed of 32 filaments and having a yarn size of 167dtex was produced by melt-spinning the yarn in a rapid spinning process as schematically illustrated in FIG. 1*a.* The spinning nozzle was conventional and had 32 holes of 0,2 mm size. The spinning temperature of the polyethylene terephthalate melt was 286° C. The extrusion speed at the nozzles was 29,4 m/min. The spun filaments were cooled in the spinning shaft conducted over a yarn treatment roll for finishing and drawn-off by the yarn forwarding godets. They were collected on a bobbin with a winding speed of 3,400 m/min by a draw-spin-winding device of the type "Barmag SW4S." Between the spinning head and the winding device there was a pre-drawing ratio of 1:115 for the as spun and drawn-off yarn. The molecular orientation of the pre-oriented yarn on the bobbin was represented by the residual stretching ratio of 1:1,74 and the birefringence value of $\Delta n = 0{,}044$. The birefringence value was measured and calculated by means of a polarization microscope, type "Standard AL 14" of Messrs. Carl Zeiss with a turntable manipulator and two perpendicularly arranged polarizers.

The pre-oriented-yarn which as collected on bobbins was processed in a high-speed crimping process according to the invention. The device for residual stretching and crimping was constructed as shown in FIG. 3, but sets of godets together with air-supported separation rolls were applied as a yarn forwarding or transporting means 12, 18 and 20 instead of the belt- or band-operated roller assemblies shown in FIG. 3. The yarn was forwarded from the first year transporting means at a speed of 1,500 m/min and fed into the residual-stretching and texturizing zone. The stretching ratio of the preoriented yarn applied in the stretching zone was 1:1,74. On the godet and on the separation roll, which were wrapped by 4 loops of the yarn, the yarn was flattened like a small band which then was conducted to a first contact heater, consisting of a slightly curved plate, which was heated by Dowtherm at a temperature of 260° C.

Immediately after having left the contact heater the filaments were quenched on a quenching device from the opposite side. The quenching surface was kept at a temperature of 10° C. The distance between the heating plate and the quenching device was 5 mm. By the unilateral heating and quenching of the transverse cross-sections of the filaments in the stretching process, the single filaments were uniformly crimped. The yarn was drawn out of the stretching zone at a speed of 2,600 m/min. at the yarn forwarding godet 18. In a heated air chamber the crimp was heat set at a temperature of 200° C under a constant relaxation tension. The yarn speed at the godet 20 was adjusted at 2,400 m/min. The winding speed of the yarn-take-up device was 2,440 m/min. The yarn showed a uniform crimp of 12 crimps per meter.

I claim:

1. Apparatus for draw-texturizing and heat-setting a thermoplastic preoriented multifilament yarn comprising:

feed means to supply the preoriented yarn to a residual stretching stage;

at least three yarn transporting means spaced from each other and operating at adjustably different rotating speeds, the second transporting means being driven at a higher rate of speed than the first transporting means to complete the residual stretching and the third transporting means bein driven at a lower rate of speed than the second transporting means to permit heat fixing of the yarn running between said second and third transporting means under adjustable relaxation conditions;

thermal treatment means located between said first and second yarn transporting means including a yarn guiding and flattening means, a yarn contact heater arranged to heat each single filament of the running yarn along one side thereof applied to the heater and unilateral cooling means following and thermally insulated from said yarn contact heater, said unilateral cooling means being arranged to quench each said single filament of the running yarn from its side opposite that applied to said yarn contact heater; and another heating means between said second and third yarn transporting means for heat-fixing the residually stretched yarn upon relaxation and self-crimping resulting from a differential shrinkage over the transverse cross-section of each individual filament.

2. The apparatus of claim 1 wherein said unilateral cooling means comprises a closed, pressure tight, hollow body having a metallic surface to contact the running yarn along one side thereof and containing a fluid cooling medium vaporizable in heat exchange with said metallic yarn contacting surface.

3. The apparatus of claim 2 including Peltier elements for adjusting the cooling temperature of the metallic yarn contacting surface of said cooling means.

4. The apparatus of claim 2 wherein a heating chamber is arranged as heat-fixing means after said second yarn transporting means, said heating-chamber having means to heat the running yarn by convection while surrounding said yarn and remaining free of direct contact with said yarn.

5. The apparatus of claim 2 wherein a heating chamber is arranged as heat-fixing means after said second yarn transporting means, said heating chamber having means to heat the running yarn by radiation while surrounding said yarn and remaining free of direct contact with said yarn.

6. The apparatus of claim 2 wherein said unilateral cooling means comprises said hollow body with an evaporator section having an enlarged inner surface area in heat exchange with said metallic yarn contacting surface, a condenser section in fluid communication with said evaporator section to receive vaporized cooling medium and a capillary means extending from said condenser section into said evaporator section to conduct liquid cooling medium along said heat conducting elements.

7. The apparatus of claim 6 wherein said condenser section is provided with cooling fins on its outer surface.

8. The apparatus of claim 6 wherein said evaporator section is arranged vertically and said condenser section is arranged horizontally with a liquid connection at the lower end of said evaporator section and a gaseous connection at the upper end of said evaporator section for circulation of said cooling medium, said capillary means reaching the upper inner surface area of said evaporator section.

9. The apparatus of claim 1 wherein means for applying a finishing agent onto the running yarn is arranged after the unilateral cooling means.

10. The apparatus of claim 1 wherein a heating chamber is arranged as heat-fixing means after said second yarn transporting means, said heating chamber having means to heat the running yarn by convection while surrounding said yarn and remaining free of direct contact with said yarn.

11. The apparatus of claim 1 wherein a heating chamber is arranged as heat-fixing means after said second yarn transporting means, said heating chamber having means to heat the running yarn by radiation while surrounding said yarn and remaining free of direct contact with said yarn.

* * * * *